US006663020B1

(12) United States Patent
Platsch et al.

(10) Patent No.: US 6,663,020 B1
(45) Date of Patent: Dec. 16, 2003

(54) MIST GENERATING HEAD

(75) Inventors: Hans Platsch, Kupferstrasse 40, Stuttgart (DE), D-70565; Walter Klaschka, Tiefenbronn (DE); Albert Kiessling, Weil der Stadt (DE)

(73) Assignees: Hans Platsch; Platsch GmbH & Co.KG

( * ) Notice: Subject to any disclaimer, the term of this patent is extended or adjusted under 35 U.S.C. 154(b) by 0 days.

(21) Appl. No.: 09/622,327

(22) PCT Filed: Dec. 17, 1998

(86) PCT No.: PCT/EP98/08311

§ 371 (c)(1),
(2), (4) Date: Aug. 15, 2000

(87) PCT Pub. No.: WO99/41016

PCT Pub. Date: Aug. 19, 1999

(30) Foreign Application Priority Data

Feb. 16, 1998 (DE) ..... 198 06 254

(51) Int. Cl.[7] ..... B05B 7/12
(52) U.S. Cl. ..... 239/412; 239/417.4
(58) Field of Search ..... 239/408, 412, 239/413, 416.4, 417.3

(56) References Cited

U.S. PATENT DOCUMENTS

| | | | | |
|---|---|---|---|---|
| 4,504,013 A | | 3/1985 | Huffman | |
| 4,676,216 A | * | 6/1987 | Ohsawa et al. | 239/412 X |
| 4,836,453 A | | 6/1989 | Poehlman | |
| 4,957,783 A | * | 9/1990 | Gabryszewski | 239/413 X |
| 5,197,674 A | * | 3/1993 | Ketterer et al. | 239/408 |
| 5,453,258 A | | 9/1995 | Lippmann et al. | |

FOREIGN PATENT DOCUMENTS

| | | | |
|---|---|---|---|
| DE | 3834674 A1 | * | 4/1990 |
| GB | 577357 | | 5/1946 |
| WO | WO 92/17279 | | 10/1992 |
| WO | WO 94/08724 | | 4/1994 |

* cited by examiner

*Primary Examiner*—Steven J. Ganey
(74) *Attorney, Agent, or Firm*—Factor & Partners

(57) ABSTRACT

The invention relates to a mist generating head (34) comprising an injection unit (70) of the type used in diesel engines. Said head atomizes the liquid to be nebulized at a high frequency. The stream of liquid droplets emitted by the injection unit (70) is surrounded and broken up further by a gas nozzle (102) which encloses the outlet opening of the injection unit and is positioned slightly downstream of same.

17 Claims, 4 Drawing Sheets

MIST GENERATING HEAD

Figure 1:
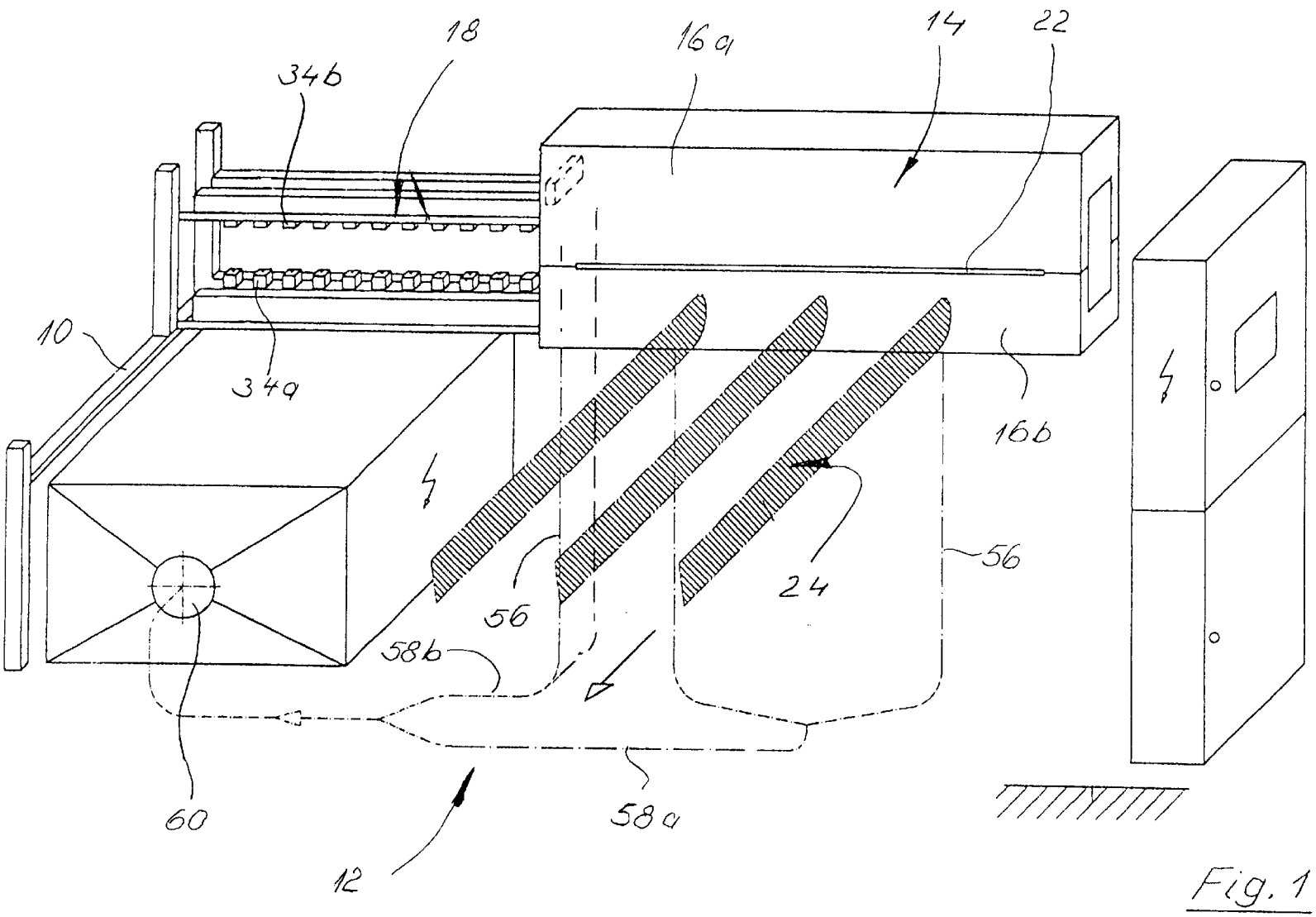

The invention relates to a mist generating head. Such known mist generating heads are employed, for example, in appliances used to increase the moisture content of ambient air or also in industrial installations, in which, for example, a film of oil or a coating of adjacent oil droplets is applied to the surface of a workpiece.

What the known mist generators have in common is that it is difficult to produce mist also from liquids of higher viscosity for, in said case, the gas jet meeting the liquid stream delivered by the liquid nozzle may no longer subdivide the liquid stream into individual droplets because the cohesion in the liquid stream is too great. Also, with the known mist generators, the generated mist quantity may not be adjusted to very low values because atomization of the liquid by means of a gas jet presupposes a specific minium flow rate of liquid through the liquid nozzle and of gas through the gas nozzle.

The object of the present invention is therefore to develop a mist generating head in a way that allows also small quantities of a liquid of higher viscosity to be reliably atomized.

According to the invention said object is achieved by a mist generating head having the features disclosed in the present invention.

In the mist generating head according to the invention, there is forced subdivision of the fed liquid into small packages by the valve body associated with the liquid nozzle. Said small liquid volumes, which are delivered each time the valve body opens, are then split up further by the gas flow so that, on the whole, a fine mist is obtained.

Good preliminary dispersion of the liquid at the liquid nozzle is obtained when the valve body cooperating with the liquid nozzle is operated at the frequency disclosed in the present invention The pressure value indicated in the present invention for the liquid to be atomized and the pressure value indicated in the present invention for the gas are advantageous likewise in view of fine, reliable nebulization of the liquid.

The geometry of the mist generating head as disclosed in the present invention has the advantage that, on the one hand, the liquid droplets derived by the liquid nozzle reach and pass through the gas jet and, on the other hand, a specific concentration and spatial confinement of the mist is effected by the gas jet and, moreover, the mist generation as a whole is effected symmetrically and uniformly.

The effect achieved by disposing the valve body axially outside of the liquid nozzle as disclosed by the present invention is that the valve body acts simultaneously as a deflector, by means of which the liquid droplets delivered by the liquid nozzle are distributed in peripheral direction.

In a mist generating head of the present invention, the gas nozzle, viewed in flow direction, may be disposed downstream of the liquid nozzle such that the stream of droplets delivered by the liquid nozzle may widen slightly before the fine atomization by the gas flow is effected. The result is better surfaces for the gas flow to act upon.

According to the present invention, the gas nozzle at the inlet side has a recess that serves to collect the mixture of droplets and gas before running into the gas nozzle, which has only a small diameter.

When an injection nozzle unit of the type indicated in the present invention is used to realize the liquid nozzle and the valve body, the cost benefits, stability under load and reliability of injection nozzles for i.c. engines may be turned to good use for nebulization of a liquid.

The development of the invention is advantageous both in view of a compact design of the mist generating head and in view of the uniformity of the generated mist.

With the development of the invention, a shaping and/or confinement of the mist stream generated by the mist generating head is obtained.

According to the present invention, the cross-sectional shape of the mist stream may easily be increased or decreased in size.

This may be realized according to the present invention by means which are mechanically extremely simple.

The effect achieved by the development of the invention is that the cross section of the mist stream may be adjusted to suit prevailing requirements by means of a control device.

Figure 2:
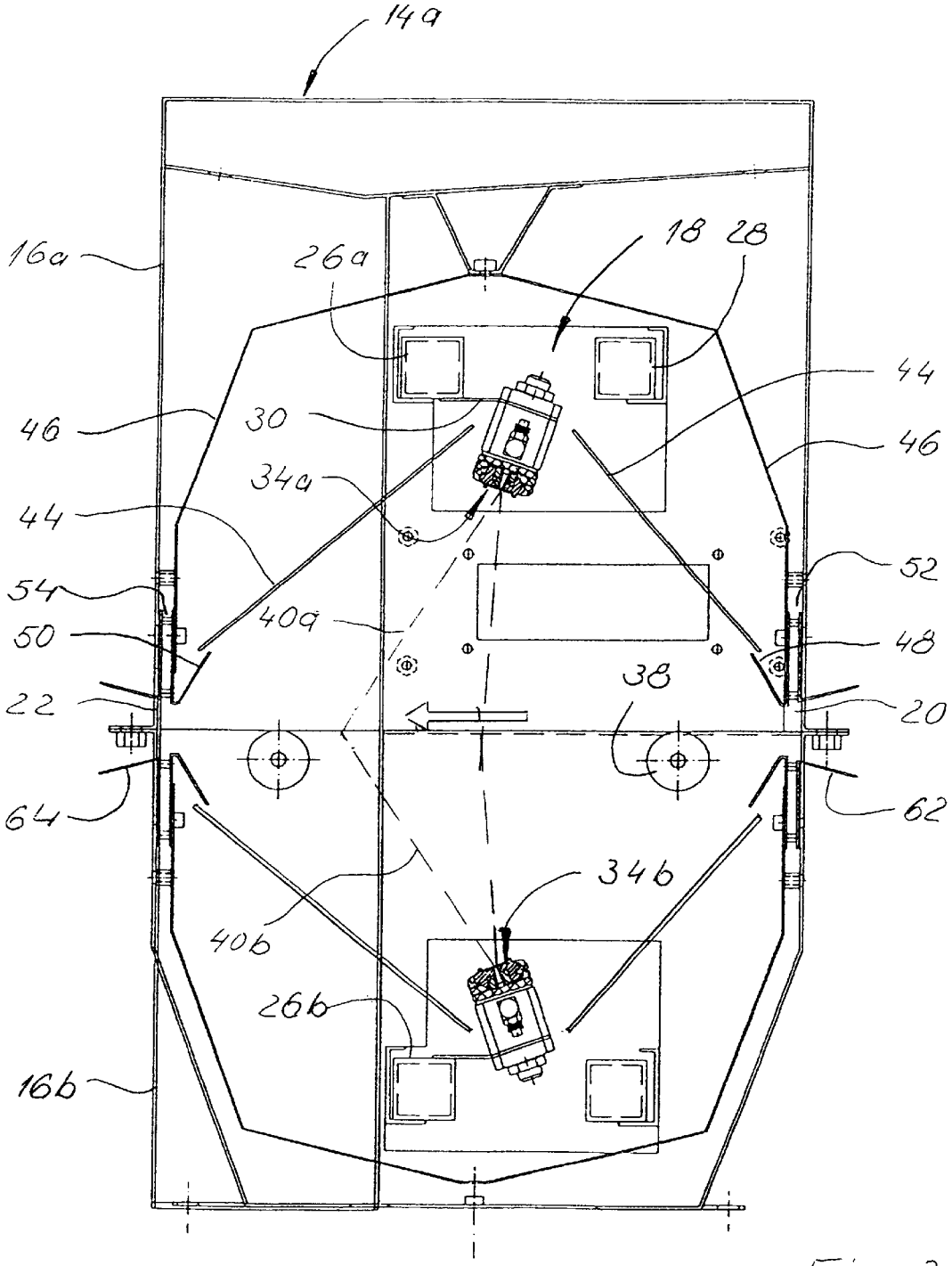
Figure 3:
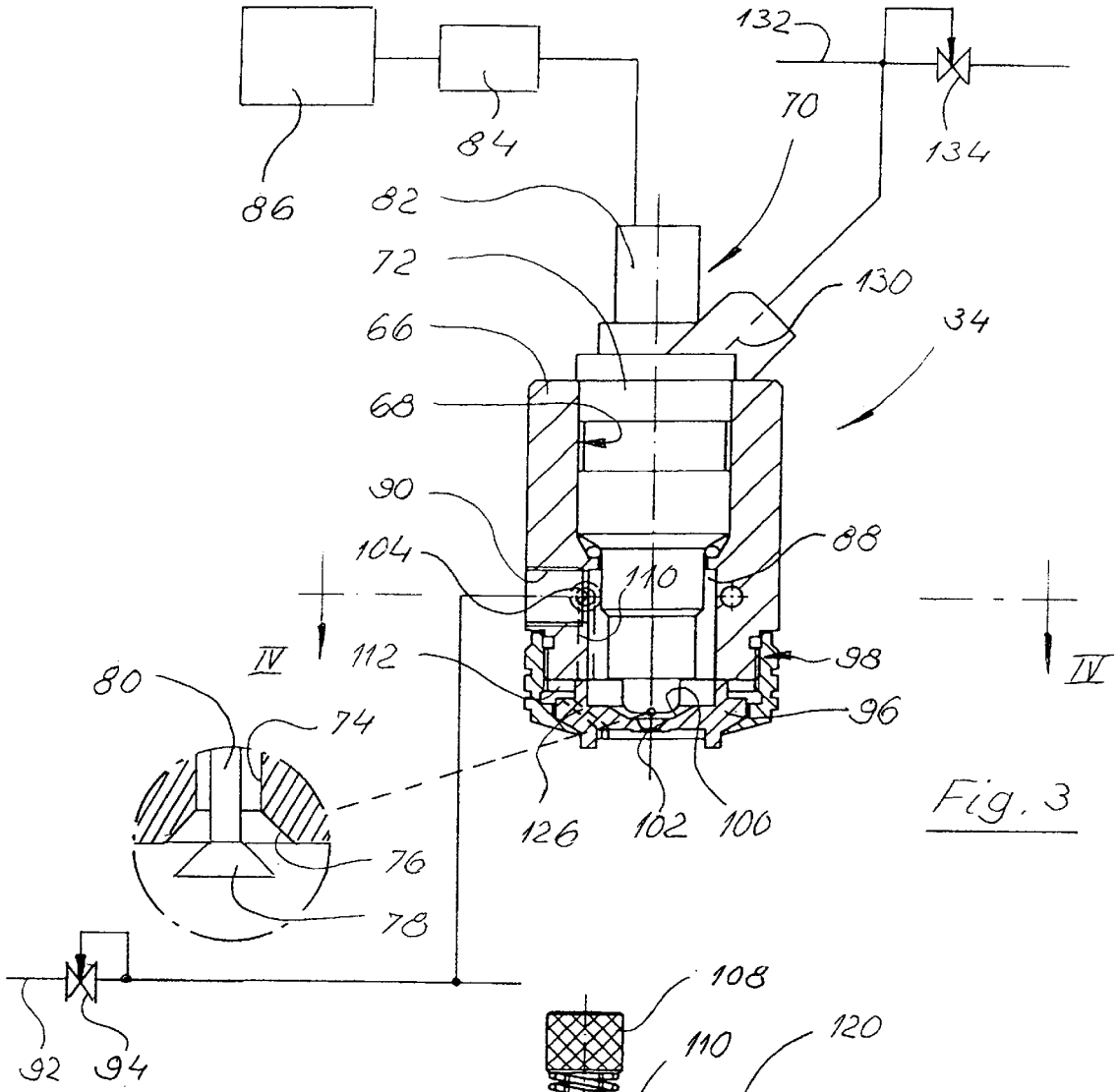
Figure 4:
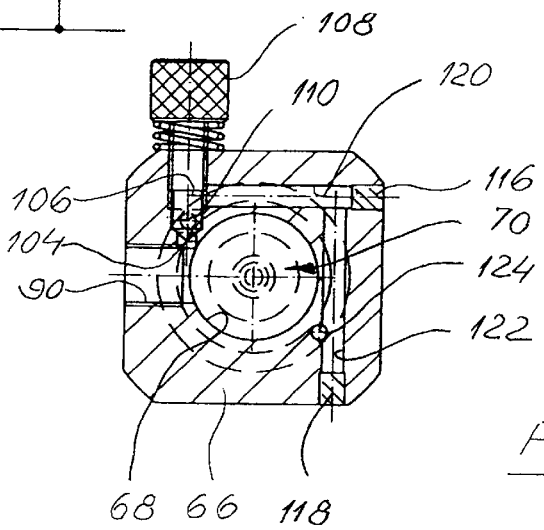
Figure 5:
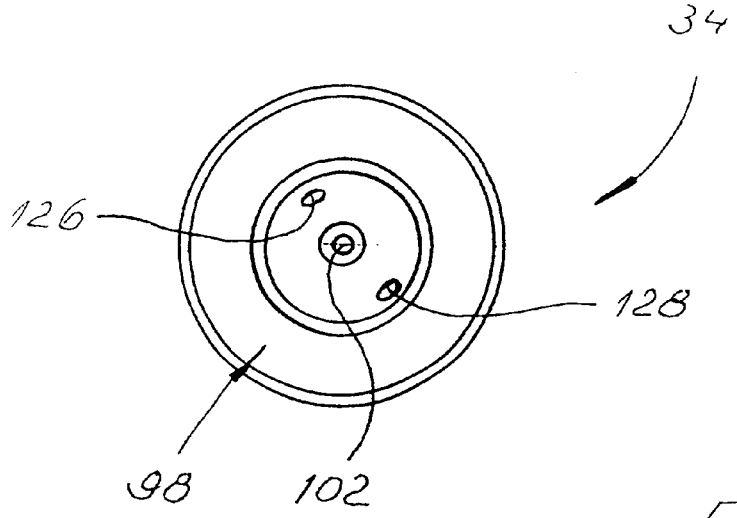
Figure 6:
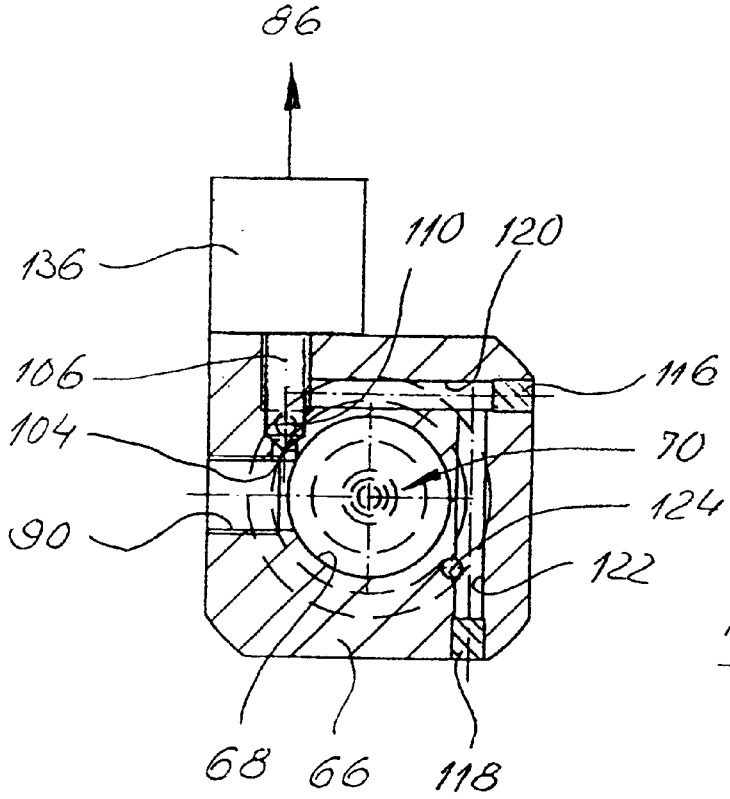

There now follows a detailed description of embodiments of the invention with reference to the drawings. Said drawings show:

FIG. 1: an exploded diagrammatic view of an installation for producing thin films of oil on metal sheets which are to be fed to a press;

FIG. 2: transverse cross section through the lubricating chamber of the installation shown in FIG. 1;

FIG. 3: an axial section through a mist generating head of the type used in the installation according to FIG. 1;

FIG. 4: a transverse section through the mist generating head shown in FIG. 3 along the cutting line IV—IV indicated there;

FIG. 5: a plan view of the bottom end face of the mist generating head according to FIG. 3 and FIG. 6: a view similar to FIG. 4 but showing a mist generating head with a controllable mist stream cross section.

In FIG. 1, 10 denotes the frame of a lubricating station denoted as a whole by 12.

A housing 14 is shown removed from a lubricating device, which is denoted as a whole by 18. Said housing comprises an upper housing part 16*a* and a lower housing part 16*b*, which together delimit an inlet slot 20 and an outlet slot 22, through which metal sheets (not shown) to be lubricated may pass.

As may be seen from the drawing, the lubricating station 12 is substantially symmetrical relative to the conveying plane of the metal sheets. Where necessary, functionally equivalent components situated above and below the conveying plane are distinguished by the suffixes a and b respectively.

For feeding and carrying away the metal sheets to be lubricated a charging conveyor, which is not shown in the drawings, and a discharge conveyor 24, which is illustrated only diagrammatically in the drawings, are used. For greater clarity the discharge conveyor, like the housing 14, is shown moved away from the actual lubricating device 18.

The lubricating device 18 comprises profiles 26, 28, which are arranged transversely relative to the conveying direction of the metal sheets. Of the profiles 26, one (26*a*) is disposed above and the other (26*b*) below the conveyor of the metal sheets. A set of upper mist generating heads 34*a* and a set of lower mist generating heads 34*b* are attached in each case by an obtuse-angled retaining plate 30 to the profile 26*a* and 26*b* respectively so as to be uniformly distributed in a transverse direction relative to the conveying direction of the metal sheets.

In the interior of the housing 14 supporting rollers 38 carry the metal sheets which are to be lubricated.

As FIG. 2 reveals, the axes 40*a*, 40*b* of the mist streams generated by the mist generating heads 34*a*, 34*b* are tilted out of the vertical through approximately 15° in conveying direction of the metal sheets. Disposed in the two housing parts 16*a*, 16*b* are baffles 44 and 46 respectively, which are spaced apart from the housing walls and at the bottom end each have an obliquely upward- and inward-extending end portion 48 and 50. Between the baffles 44, 46 and the vertical walls of the housing parts 16*a*, 16*b* there remains in each case a gap 52, 54, which is connected by lines 56, 58 to a suction channel 60, upon which an extractor (not shown in the drawing) operates.

The vertical walls of the housing parts 16*a*, 16*b* at the bottom end have in each case end portions 62, 64, pairs of which form in each case an admission hopper and a discharge hopper for the metal sheets which are to be lubricated.

As FIGS. 3 to 5 reveal, the mist generating heads 34 each have a housing 66, in which a central, multi-stepped bore 68 is provided. An injection unit 70 of the type used for fuel injection in diesel engines is inserted into the stepped bore 68. The injection unit 70 has a housing 72, which at its outside has a plurality of shoulders and in its bottom end face has a liquid nozzle 74. The liquid nozzle 74 simultaneously has at the outlet side a valve seat 76 in the shape of a truncated cone, which cooperates with a valve body 78 carried by a valve stem 80.

The valve stem 80 extends, in the drawing, up through the housing 72 and is connected at the top end to the armature of an electromagnet 82, which is excited from a control unit 84. The latter receives from a master control device 86 signals which specify the frequency, at which the electromagnet 82 is activated, the pulse duty factor between open and closed time of the valve body 78 and optionally the amplitude of the supply current fed to the electromagnet 82 (and hence the opening travel of the valve body 78).

The valve may operate at a frequency of about 10 to about 100 Hz. In an advantageous embodiment, the valve operates at a frequency of approximately 60 Hz.

The stepping of the bore 68 and the graduation of the outer surface of the housing 72 give rise in the bottom portion of the housing 72 to an annular space 88. The latter communicates via an inlet 90 with a compressed-air line 92. The latter contains a pressure regulator 94.

An air nozzle disk 96 is screwed by means of a threaded ring 98 tightly up against the bottom end face of the housing 66. The air nozzle disk 96 in its top boundary surface has a truncated-cone-shaped recess 100, which surrounds the bottom end of the housing 72 with clearance and leads as a funnel to a likewise truncated-cone-shaped nozzle aperture 102, which opens out into the bottom free end face of the air nozzle disk 96.

As FIG. 4 reveals, branching off from the inlet 90 is a lateral channel 104, in which a truncated-cone-shaped valve seat not provided with a reference character is formed and cooperates with a needle valve body 106, which has a conical tip, runs in a thread of the housing 66 and may be operated at a knurled end portion 108. Emanating from the portion of the lateral channel 104 situated downstream of the valve seat formed in the lateral channel 104 is an axial control air channel 110, which leads to a further annular space 112 situated between the underside of the housing 66, the top of the air nozzle disk 96 and the inner surface of the threaded ring 98.

Via bores 120, 122 of the housing 66, which are closed by stoppers 116, 118, a further vertical control air channel 124 is acted upon, which opens into the annular space 112 diametrically opposite the entry point of the control air channel 110.

Opening out into the free end face of the air nozzle 96 are control nozzle channels 126, 128, which emanate from the annular space 112 and are a continuation of the control air channels 110, 124, as FIG. 5 reveals.

A liquid feed channel 130 of the injection unit 70 is connected to a distribution line 132, in which a pressure regulator 134 keeps the liquid to be atomized (oil) at a pressure of 2 to 8 bar, preferably approximately 4 to 5 bar. The pressure adjusted by the pressure regulator 94 in the compressed-air line 92 is approximately 2 to 4 bar.

The pressure values actually used in each case depend on the nature, in particular the viscosity of the liquid to be atomized in each case and the size of the desired droplets as well as the desired velocity of the mist stream.

During operation, the electromagnet 82 is excited by the control unit 84 in each case at the adjusted frequency and with the set pulse duty factor. Each time the electromagnet is excited, a preset small liquid volume is delivered through the liquid nozzle 74 and is subjected simultaneously to preliminary atomization.

On leaving the liquid nozzle, said liquid droplets come into intimate contact with the sleeve-like air jet flowing around the bottom end of the injection unit 70 and are split up further in said air jet. At the outlet of the nozzle aperture 102 a fine liquid mist is obtained.

When the needle valve body 106 is in the closed position, the external contour of said liquid mist corresponds to a cone. By opening the needle valve body 106, the mist cone may be pressed flat from two opposite directions so that the transverse cross-section of the mist assumes a shape similar to a rectangle.

In the modified example according to FIG. 6, the needle valve body 106 is supported so as to be displaceable in axial direction in the housing 66 and is firmly connected to the armature of an electromagnet 136. Via the supply current of the electromagnet 130 the control unit 86 may therefore easily control the cross-sectional shape of the mist stream.

What is claimed is:

1. A mist generating head for generating a mist of liquid droplets distributed in a gas flow for producing a liquid film or a layer of adjacent liquid droplets on the surface of a workpiece, having a housing (66, 96), in which a liquid feed channel (130) and a gas feed channel (90) are formed, and having a nebulizing device connected to the liquid feed channel (130) and the gas feed channel (90), the nebulizing device comprising a liquid nozzle (74) connected to the pressurized liquid feed channel (130); the liquid flow through the liquid nozzle (74) being controllable by an intermittently operable valve (76, 78), the housing (66, 96) carrying a gas nozzle (102) which is connected to the gas feed channel (90), and the directional characteristics of liquid nozzle (74) and gas nozzle (102) overlapping, wherein the valve member (78) of the valve (76, 78) operates at a frequency of about 10 to about 100 Hz.

2. A nozzle unit as claimed in claim 1, wherein the valve body (78) operates at a frequency of approximately 60 Hz.

3. A mist generating head as claimed in 1, wherein the pressure in the liquid feed channel (130) is between 2 and 8 bar.

4. A mist generating head as claimed in claim 1, wherein the pressure in the gas feed line (92) is between approximately 2 and 4 bar.

5. A mist generating head as claimed in claim 1, wherein the gas nozzle (102) encloses the liquid nozzle (74) in radial direction.

6. A mist generating head as claimed in claim 1, wherein the valve body (78) is disposed axially outside of the liquid nozzle (74).

7. A mist generating head as claimed in claim 1, wherein the gas nozzle (102), viewed in flow direction, is disposed downstream of the liquid nozzle (74).

8. A mist generating head as claimed in claim 7, wherein the gas nozzle (102) at the inlet side has a recess (100).

9. A mist generating head as claimed in claim 1, wherein a fuel injection unit (70) having a cylindrical outer surface is inserted into a cylindrical bore (68) of a housing main part (66) and in a portion adjacent to a free outlet opening of the bore (68) is spaced apart in a radially inward direction from the inner surface of the bore so as to form an annular space (88), which communicates with the gas inlet (90).

10. A mist generating head as claimed in claim 1, wherein a free end face of the housing (66, 96), in which the gas nozzle (102) opens out, has at least two control gas nozzles (126, 128) distributed uniformly in peripheral direction.

11. A mist generating head as claimed in claim 10, having a device (106) for adjusting the control gas flow.

12. A mist generating head as claimed in claim 11, wherein the device for adjusting the control gas flow comprises a needle valve (106).

13. A mist generating head as claimed in claim 11, wherein the device (106) for adjusting the control gas flow is operable by means of a servomotor (130).

14. A mist generating head as claimed in claim 1 wherein the pressure in the liquid feed channel (130) is between approximately 4 and 5 bar.

15. A mist generating head as claimed in claim 1 wherein the pressure in the liquid feed channel (130) is between approximately 4 and 5 bar.

16. A mist generating head for generating a mist of liquid droplets distributed in a gas flow for producing a liquid film or a layer of adjacent liquid droplets on the surface of a workpiece, having a housing (66, 96), in which a liquid feed channel (130) and a gas feed channel (90) are formed, and having a nebulizing device connected to the liquid feed channel (130) and the gas feed channel (90), the nebulizing device comprising a liquid nozzle (74) connected to the pressurized liquid feed channel (130) having a pressure between 2 and 8 bar; the liquid flow through the liquid nozzle (74) being controllable by an intermittently operable valve (76, 78), the housing (66, 96) carrying a gas nozzle (102) which is connected to the gas feed channel (90), and the directional characteristics of liquid nozzle (74) and the gas nozzle (102) overlapping, wherein the valve member (78) of the valve (76, 78) operates at a frequency of about 10 to about 100 Hz.

17. A mist generating head for generating a mist of liquid droplets distributed in a gas flow for producing a liquid film or a layer of adjacent liquid droplets on the surface of a workpiece, having a housing (66, 96), in which a liquid feed channel (130) and a gas feed channel (90) are formed, and having a nebulizing device connected to the liquid feed channel (130) and the gas feed channel (90), the nebulizing device comprising a liquid nozzle (74) connected to the pressurized liquid feed channel (13); the liquid flow through the liquid nozzle (74) being controllable by an intermittently operable valve (76, 78), the housing (66, 96) carrying a gas nozzle (102) which is connected to the gas feed channel (90), and the directional characteristics of liquid nozzle (74) and the gas nozzle (102) overlapping, wherein the valve member (78) of the valve (76, 78) operates at a frequency of approximately 60 Hz.

* * * * *